US005364752A

United States Patent [19]

Timmerman et al.

[11] Patent Number: 5,364,752

[45] Date of Patent: Nov. 15, 1994

[54] PHOTOGRAPHIC SILVER HALIDE ELEMENT HAVING ANTISTATIC PROPERTIES

[75] Inventors: Daniel M. Timmerman; Hubert Vandenabeele, both of Mortsel, Belgium

[73] Assignee: Agfa-Gevaert, N.V., Mortsel, Belgium

[21] Appl. No.: 9,731

[22] Filed: Aug. 19, 1993

Related U.S. Application Data

[63] Continuation of Ser. No. 842,604, Feb. 27, 1992, abandoned.

[30] Foreign Application Priority Data

Mar. 28, 1991 [EP] European Pat. Off. ..... 91200734.1

[51] Int. Cl.[5] ..... G03C 1/85

[52] U.S. Cl. ..... 430/529; 430/510; 430/527

[58] Field of Search ..... 430/510, 527, 529

[56] References Cited

U.S. PATENT DOCUMENTS

| | | | |
|---|---|---|---|
| 4,147,550 | 4/1979 | Campbell et al. | 430/529 |
| 4,388,402 | 6/1982 | Mukunoki et al. | 430/529 |
| 4,396,708 | 8/1983 | Ogawa et al. | 430/529 |
| 4,582,782 | 4/1986 | Valsecchi | 430/529 |
| 4,585,730 | 4/1986 | Cho | 430/529 |

*Primary Examiner*—Jack P. Brammer

*Attorney, Agent, or Firm*—Breiner & Breiner

[57] ABSTRACT

A recording material comprising a sheet, ribbon or web support and a hydrophilic colloid binder layer incorporating an ionic copolymer in the form of dispersed particulate material providing to said material an antistatic character, characterized in that said ionic copolymer is a cross-linked addition copolymer wherein at least 30 mole % of its recurring units are recurrring units containing a sulphonic acid salt group that has been obtained via a reaction of propane sultone or butane sultone with carboxylate salt groups present originally in recurring units of said copolymer.

4 Claims, 2 Drawing Sheets 1
2
log Rs
14
13
12
11
10
9
8
pH
0
2
4
6
8
10
12

PHOTOGRAPHIC SILVER HALIDE ELEMENT HAVING ANTISTATIC PROPERTIES

This is a continuation of co-pending application Ser. No. 07/842,604 filed on Feb. 27, 1992, now abandoned.

FIELD OF THE INVENTION

The invention is concerned with recording materials wherein a sheet, ribbon or web carries an antistatic layer.

BACKGROUND OF THE INVENTION

It is known that resin films or resin coated papers of low conductivity become electrostatically charged by friction with dielectric materials and/or contact with electrostatically chargeable transport means, e.g. rollers. The charging occurs particularly easily in a relatively dry atmospheric environment.

Sheets, ribbons and webs made of hydrophobic resin or coated with such resin, e.g. a polyester resin or cellulose triacetate, are commonly used as base materials or supports in recording materials. Such supports are subjected to frictional contact with other elements during the manufacture of the recording materials, e.g. during a coating or cutting stage, and during use, e.g. during the recording of information or (in the case of silver halide photographic materials) during image-processing or projection. Especially in the reeling-up or unreeling of dry photographic film in a camera or projector high friction may build up, resulting in electrostatic charges that may attract dust or cause sparking. In unprocessed photographic silver halide emulsion materials sparking causes undesirable exposure marks and degrades the image quality.

In order to reduce electrostatic charging of sheets or webs comprising a hydrophobic resin layer or support without impairing their transparency it is known to apply coatings which are formed of or incorporate ionic compounds such as antistatic high molecular weight watersoluble polymeric compounds having ionic groups at frequent intervals in the polymer chain [ref. e.g.Photographic Emulsion Chemistry, by G. F. Duffin, - The Focal Press - London (1966) - Focal Press Limited, p. 168, and U.S. Pat. No. 4,301,240]. Examples of polymers that have been used for this purpose include salts of polyacrylic acid, of polystyrene sulphonic acid and copolymers which contain quaternary ammonium groups. However, watersoluble antistatic substances ingredients will not remain when the treated sheet or web materials are subjected to an aqueous treatment as is common e.g. in the processing of photographic silver halide emulsion materials.

Thus, watersoluble ionic polymers containing protonated or quaternized amino groups, although providing a good antistatic character before aqueous processing will not offer a satisfactory electrical conductivity for preventing electrostatic dust-attraction of a dried resin film support of a wet-processed photographic silver halide emulsion material since said polymers are leached out from the coated material in the aqueous processing.

In U.S. Pat. No. 4,301,240 a photographic material is described wherein for the purpose of improving mechanical and electrostatic properties a cross-linked acrylic or methacrylic polymer salt is used in dispersed form in a hydrophilic colloid layer binder layer such as a gelatin containing layer of a photographic gelatin-silver halide emulsion layer material.

In U.S. Pat. No. 4,677,050 still other carboxylate containing cross-linked copolymers as defined by their general formula (I) are added in dispersed form in water to hydrophilic coating compositions of photographic silver halide emulsion materials to improve their antistatic character.

The advantages of the use of said dispersed polymeric carboxylate salts, follow from their resistance to diffusion, low swelling power and their property of not influencing the viscosity of gelatinous coating compositions. The dispersed cross-linked polymeric carboxylate salts remain by their insolubility resistant to diffusion in hydrophilic colloid layers under conditions of pH encountered in photographic processing liquids for treating imagewise photo-exposed silver halide emulsion layer materials.

It has been found experimentally by us that especially the alkaline metal salts of said cross-linked carboxylate polymers improve the electrical conductivity of a hydrophilic colloid layer but that said conductivity drops markedly in aqueous media having a pH lower than 5. Since particular acid fixing liquids acting simultaneously as stop bath for the alkaline development have a pH below 5, e.g. in the range of 5 to about 4 a remedy for the sudden decrease in conductivity at said lower pH values has to be found.

It has further found experimentally by us that latices on the basis of cross-linked polymers containing quaternary ammonium salt groups after being treated in alkaline aqueous processing liquids have lost much of their conductivity increasing character.

SUMMARY OF THE INVENTION

It is an object of the present invention to provide a recording material including a sheet, ribbon or web support and a hydrophilic colloid binder layer incorporating an ionic cross-linked copolymer in the form of a dispersion which copolymer provides a satisfactory electrical conductivity to said material even after wet treatment at pH values lower than 5.

Other objects and advantages of the present invention will appear from the further description and examples.

According to the present invention there is provided a recording material comprising a sheet, ribbon or web support and a layer incorporating an ionic copolymer applied in the form of an aqueous dispersion providing to said material an antistatic character, characterized in that said ionic copolymer is a cross-linked addition copolymer wherein at least 30% of its recurring units are recurrring units containing a sulphonic acid salt group that has been obtained via a reaction of propane sultone or butane sultone with carboxylic acid or carboxylate salt groups present originally in recurring units of said copolymer.

The ionic cross-linked addition copolymers used according to the present invention are easily dispersable in aqueous medium, do not increase the viscosity of an aqueous gelatin solution, do not coagulate gelatin, and have no matting effect in gelatin coatings.

SHORT DESCRIPTION OF THE DRAWINGS

FIG. 1 represents graphs wherein surface resistivity expressed as logarithmic value (log $R_s$) is plotted against pH of gelatin layers containing respectively a prior art cross-linked carboxylate copolymer and a cross-linked sulphonate copolymer according to the present invention.

FIG. 2 represents a graph wherein the surface resistivity (log $R_s$) of gelatin layers containing sulphonated cross-linked copolymers is plotted against the increasing transformation (in mole %) of carboxylate groups into sulpho-alkyl acrylate groups. The surface resistivity measurement takes place after subjecting said layers to an aqueous processing treatment for photo-exposed photographic silver halide emulsion layer materials (see Example 1).

DETAILED DESCRIPTION OF THE INVENTION

Figure 1:
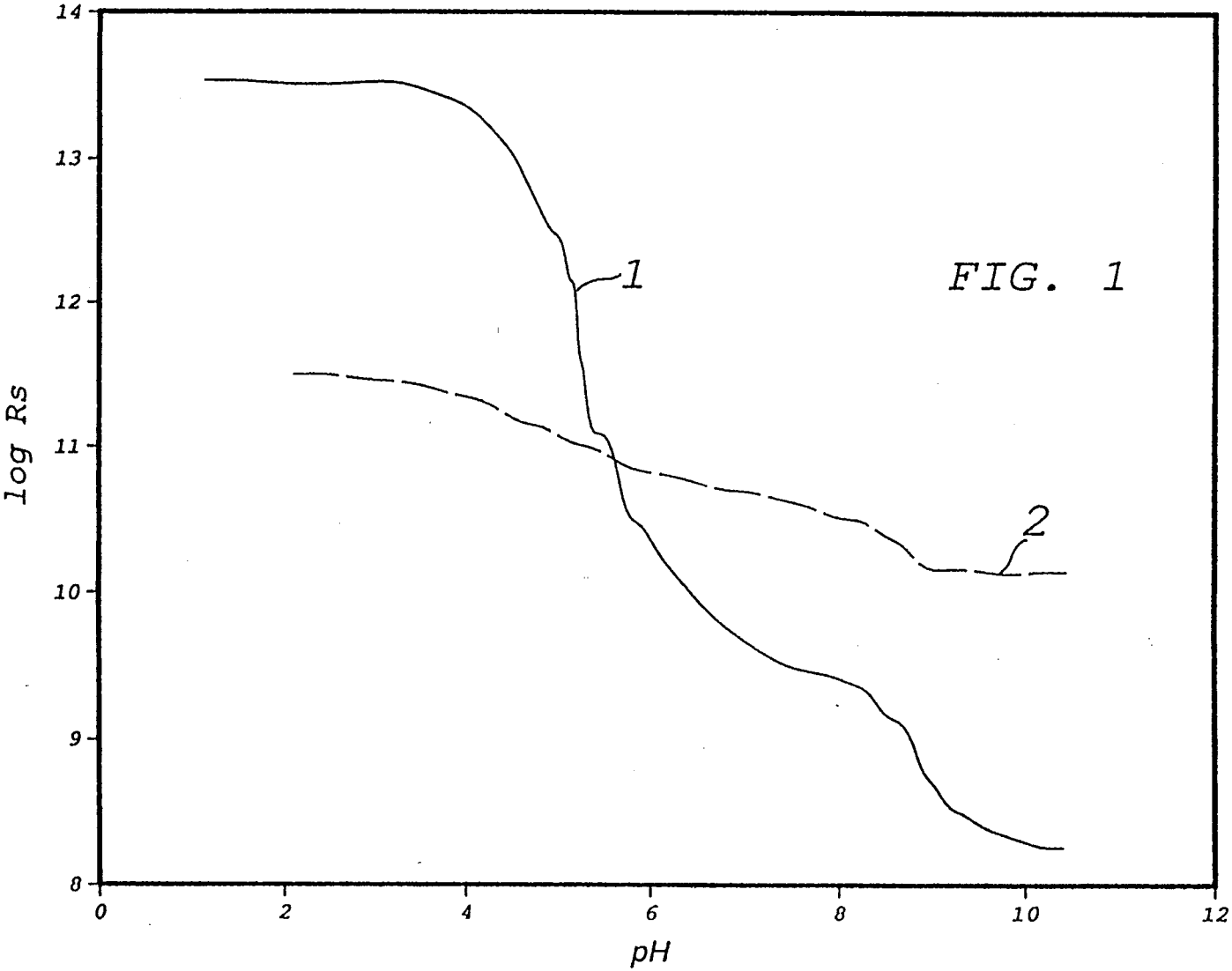

According to a preferred embodiment for improving the antistatic properties of hydrophilic colloid layers said ionic cross-linked addition copolymer is incorporated therein in alkali metal salt form, e.g. as potassium salt.

The cross-linking in the addition copolymers proceeds preferably with at least one copolymerizable cross-linking monomer containing at least two ethylenically unsaturated groups.

According to a preferred embodiment said ionic cross-linked addition copolymer is prepared with 1 to 10 mole % of polyfunctionally ethylenically unsaturated addition polymerizable cross-linking monomers to obtain water-insolubility of the copolymer.

Suitable polyfunctionally ethylenically unsaturated monomers acting as cross-linking agents are e.g. divinyl benzene, trivinyl cyclohexane, trivinyl benzene, 2,3,5,6-tetrachloro-1,4-divinylbenzene, esters of unsaturated acids with unsaturated alcohols, e.g. vinyl crotonate, allyl methacrylate, allyl crotonats, esters of unsaturated acids with polyfunctional alcohols, e.g. trimethylol propane trimethacrylate, neopentyl glycol dimethylacrylate, butanediol dimethylacrylate, pentaerythritol-triacrylate, tetraethylene glycol-diacrylate, triethylene glycol diacrylate, esters of unsaturated alcohols with polyfunctional acids, e.g. diallyl phthalate and unsaturated polyethers, e.g. triethylene glycol-divinyl ether and tetraallyloxyethane.

The copolymers used according to the present invention may comprise non-ionic monomers including an oxyalkylene group, e.g. oxyethylene group such as the monomers represented by formula (III) of U.S. Pat. No. 4,677,050.

A new cross-linked ionic addition copolymer particularly suited for use according to the present invention consists of:

(1) recurring units being acrylic and/or methacrylic acid aliphatic ester groups,
(2) recurring units being acrylic and/or methacrylic acid salt groups, optionally in conjunction with said units in free acid form, and
(3) recurring units containing a sulphonic acid salt group obtained via a reaction of propane sultone or butane sultone with carboxylic acid salt groups present originally in recurring units of said copolymer, and wherein the recurring units (3) represent at least 30 mole % of the recurring units of said copolymer.

Preferred ionic cross-linked addition copolymers for use according to the present invention include at most 30 mole % of acrylic acid alkali metal salt and/or onium salt groups, optionally an amount of said groups being transformed into free acid groups, at most 19 mole % of acrylate alkyl ester units, e.g. methyl ester units, 1 to 10 mole % of tetraallyloxyethane as polyfunctional cross-linking monomer, and at least 50 mole % of recurring units having linked to the polymer backbone the group $—COO—(CH_2)_n—SO_3^-.M^+$, wherein n is 3 or 4, and $M^+$ is a cation selected from the group consisting of an alkali metal cation and onium group, e.g. ammonium. The transformation in free acid groups of the salt groups proceeds by acidification in aqueous medium, e.g. with HCl.

The ionic cross-linked copolymers used according to the present invention can be prepared by the steps of:

(1) the emulsion polymerisation of addition polymerizable aliphatic ester monomers, e.g. methyl acrylate, in the presence of addition polymerizable multifunctional monomers, e.g. tetraallyloxyethane,
(2) the transformation of at least a part of the ester groups in alkali metal carboxylate groups by saponification,
(3) the transformation of at least a part of said carboxylate groups with propane sultone and/or butane sultone to form sulphonic acid salt groups.

For the production of specific cross-linked addition copolymers containing carboxylic acid salt groups that may serve in the formation of sulphonate groups according to the above defined process reference is made to U.S. Pat. No. 4,301,240 and 4,677,050.

By emulsion polymerisation copolymers with a molecular weight well above 500,000 can be obtained and the average particle size of the obtained polymer particles in dispersed form (latex) latex is smaller than 150 nm.

In order to illustrate the synthesis of ionic cross-linked copolymers useful as antistatic agent in hydrophilic colloid coatings of a recording material according to the present invention the following preparations I, II, III and IV are given hereinafter in detail.

Preparation I relates to the production of an acrylate ester copolymer. Preparation II relates to the partial saponification of said acrylate copolymer to a corresponding potassium salt.

Preparation III relates to the partial conversion of the potassium salt to free carboxylic acid by adjusting the pH to 7. The obtained copolymer is used in a comparative test given in Example 2 furtheron.

Preparation IV relates to the production of a sulphonic acid potassium salt copolymer according to the present invention derived from the copolymer of Preparation II via Preparation III.

Preparations I & II

I. Poly([c.l.]tetraallyloxyethane-co-methyl acrylate) (3/97 molar ratio)

In a 300 l glass lined reaction vessel provided with reflux condenser, two inlet openings and hot water heating jacket were introduced at moderate stirring 900 g of DOWFAX 2A1 (trade name of DOW Chemicals for a mixture of dodecylated oxydibenzene disodium sulfonate and disulfonated dodecyl diphenyloxide being emulsifying agents) dissolved in 159 l of demineralized water.

Before introduction into the reaction vessel 41.2 kg (479 mole) of methyl acrylate were thoroughly mixed with 3.77 kg (14.8 mole) of distilled tetraallyloxyethane.

Likewise before introduction into the reaction vessel an initiator solution was prepared separately by dissolving 225 g of potassium persulphate in 16 l of demineralized water.

At a reaction temperature in the range of 70° to 75° C. 1/10th of the available monomer mixture and 1/10th of the initiator solution were introduced with rapid stirring into the emulsifier solution over a period of 5 to 10 minutes.

In the course of the following 15 minutes a slightly exothermic reaction was noticed and the remaining monomer mixture and initiator solution was added gradually over a period of 1 h whereby the reaction temperature reached a maximum of 88° C. and a regular reflux of methyl acrylate was obtained. After completion of the introduction of monomer mixture and initiator solution stirring was continued for 1 h while the reaction temperature dropped to about 80° C. Then the reaction mixture was cooled down to 25°–30° C.

About 220 kg of latex were obtained containing 21 g of cross-linked copolymer in 100 g of dispersion. The latex particles had an average particle size of 90–130 nm. The pH of the latex was in the range of 2.5 to 3 and the viscosity was 2.5 mPa.s at 25° C.

II. Poly([c.l.]tetraallyloxyethane-co-methyl acrylate/-potassium acrylate) (3/18/79 molar ratio)

In a 80 l stainless steel reaction vessel provided with reflux condenser and 20 l addition funnel 37.9 kg of the above prepared latex (containing about 7.94 kg of copolymer comprising about 85 mole of polymerized methyl acrylate) was introduced and slowly heated to 95° C. Then 8.1888 kg of potassium hydroxide (50% wt) in water was added over a period of 30 minutes. During the introduction of the potassium hydroxide solution the temperature of the saponification mixture was kept at about 95° C. and by carefully controlled heating a weak reflux of methanol was maintained hereby avoiding foaming.

The saponification mixture was boiled for a further 8 h having the boiling point dropping from 100° C. to 98° C. After cooling the reaction mixture was filtered through a qualitative fast speed filter paper.

Preparation III

Poly([c.l.]tetraallyloxyethane-co-methyl acrylate/-potassium acrylate/acrylic acid) (3/16.8/60.2/20 molar ratio)

The filtrate obtained in Preparation II was neutralized to pH 7.0 by adding the necessary quantity of ion exchange resin LEWATIT S 100 (trade name of BAYER A.G. for a sulfonated styrene divinylbenzene copolymer in acidic form). After removing the ion exchange resin by filtering through filter cloth and by adding an adequate amount of demineralized water (pH=7) a latex with 14.77 wt % of the above mentioned copolymer was obtained. In 1 kg of said latex were present 147.7 g of dry copolymer containing 95.207 g (0.8655 mole) of potassium acrylate units, 20.752 g (0.2882 mole) of acrylic acid units, 20.768 g (0.2415 mole) non-saponified methyl acrylate units and 10.959 g (0.0431 mole) of tetraallyloxyethane units. The latex copolymer (average particle size: 102.8 nm) is called the K+-polymer.

Preparation IV

III. Poly([c.l.]tetraallyloxyethane-co-methyl acrylate/-potassium acrylate/potassium 4-sulpho-butylacrylate)

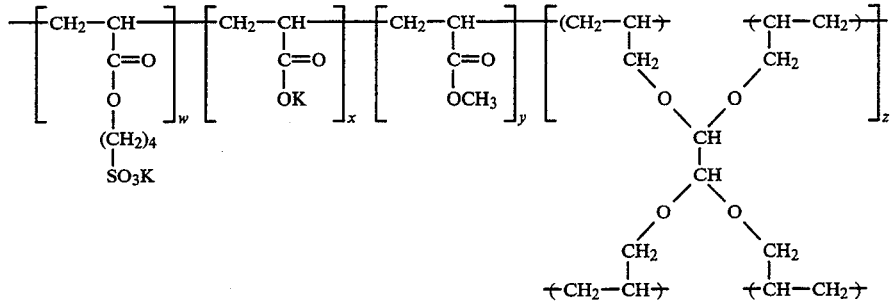

w = 54.75 mole %
x = 25.45 mole %
y = 16.8 mole %
z = 3 mole %

In a double-wall glass reactor of 10 l equipped with two dropping funnels, stirrer, reflux condenser, thermometer and pH meter with electrode inside the reactor 7421.4 g of the above prepared latex (preparation III) containing 1096.14 g of K+ polymer were introduced. The dispersion was heated to 75° C. by flowing water of 75° C. through the double-wall structure of the reactor.

In one of the dropping funnels 1593.75 g (11.704 mole) of butane sultone and in the other dropping funnel 1955.4 g of a 26.7 wt % aqueous potassium hydroxide solution were introduced.

To the latex in the reactor at 75° C. about 477 g of said aqueous potassium hydroxide solution were added to reach a pH of 11.0. Operating that way the still free carboxylic acid groups of said K+ polymer were transformed quantitatively into potassium carboxylate groups. The total amount of potassium carboxylate in the dispersion was 8.5623 mole.

While stirring to the latex at 75° C. butane suitone kept at room temperature in its dropping funnel was added at a rate of 13 g per minute. After two hours the total amount of butane sultone was added and the pH dropped thereby to 6.16.

By adding about 264 g of said aqueous potassium hydroxide solution the pH was raised again to 7.0.

After 2 h 40 min the pH dropped again to about 6.21 and was adjusted to 7.0 with about 270 g of said aqueous potassium hydroxide solution. Such operation was repeated thrice in the further course of the reaction, i.e. after a reaction duration of 3 h 30 min with about 190.1 g of said solution, after 4 h 15 min with about 160 g of said solution, and after 5 h with about 219 g of said aqueous potassium hydroxide solution, the pH being raised hereby to 8.05. The reaction temperature of 75° C. was kept for 20 h, whereupon cold tap water was circulated through the double wall of the reactor to bring the reactor content down to room temperature. During said procedure the pH inside the reactor dropped to 5.16 and was subsequently raised to about 11.0 by introducing 374.8 g of said aqueous potassium hydroxide solution.

The thus obtained dispersion was poured into 49.5 l of methanol with stirring. A fine white powder of Poly([c.l.]tetraallyloxyethane-co-methyl acrylate/potassium acrylate/potassium 4-sulpho-butylacrylate) separated.

After a decantation time of 1 h the copolymer was separated by filtration and stirred again in a mixture of 1.06 l of demineralized water and 6.00 l of methanol. The powder was separated again by filtration and dried at 50° C. to remove moisture, first under reduced pressure obtained by water-jet pump and finally under still lower pressure (1 mm Hg).

Yield of the copolymer: 2004.8 g.

By analysis it was found that the copolymer corresponded to poly([c.l.]tetraallyloxyethane-co-methyl acrylate/potassium acrylate/potassium 4-sulpho-butylacrylate) (3.0/16.8/25.45/54.75 molar ratio).

For use as antistatic agent 2004.8 g of said dried powder were first dispersed in 11.360 kg of demineralized water. The pH becoming 10.0 after a period of 12 h was adjusted to neutral (pH=7) by adding hydrochloric acid. An amount of 13.573 kg of copolymer dispersion was obtained with 1.979 kg of dry copolymer, the latex particles of which had an average particle size of 131.4 nm.

By the addition of hydrochloric acid a part of the potassium acrylate units was transformed into acrylic acid units whereby the composition of the copolymer corresponded to poly([c.l.]tetraallyloxyethane-co-methyl acrylate/potassium acrylate/acrylic acid/potassium 4-sulpho-butylacrylate) (3.0/16.8/19.1/6.35/54.75 molar ratio).

In FIG. 1 the good antistatic properties under different pH conditions of a hydrophilic colloid layer containing an ionic cross-linked sulphonate copolymer according to the present invention are compared with an ionic cross-linked carboxylate copolymer from which the sulphonate copolymer has been derived. Graphs 1 and 2 in said drawing represent the surface resistivity expressed as log $R_s$ versus pH of gelatin layers containing respectively the cross-linked carboxylate copolymer (curve 1) prepared according to Preparation II and the therefrom derived cross-linked sulphonate copolymer (curve 2) prepared according to Preparation IV. In said layers applied to a subbed polyethylene terephthalate support at a dry coating thickness of 4.0 μm the gelatin/copolymer weight ratio was 30/70. After hardening of the gelatin under the same conditions each coated and dried material was divided into several strips and pairs of strips of each material were soaked each in a different demineralized aqueous liquid the pH of which was varied from liquid to liquid with a pH increment of 1. The soaked samples were dried and before measurement of the surface resistivity were conditioned for 15 h at 20° C. and 30 relative humidity (R.H.).

Figure 2:
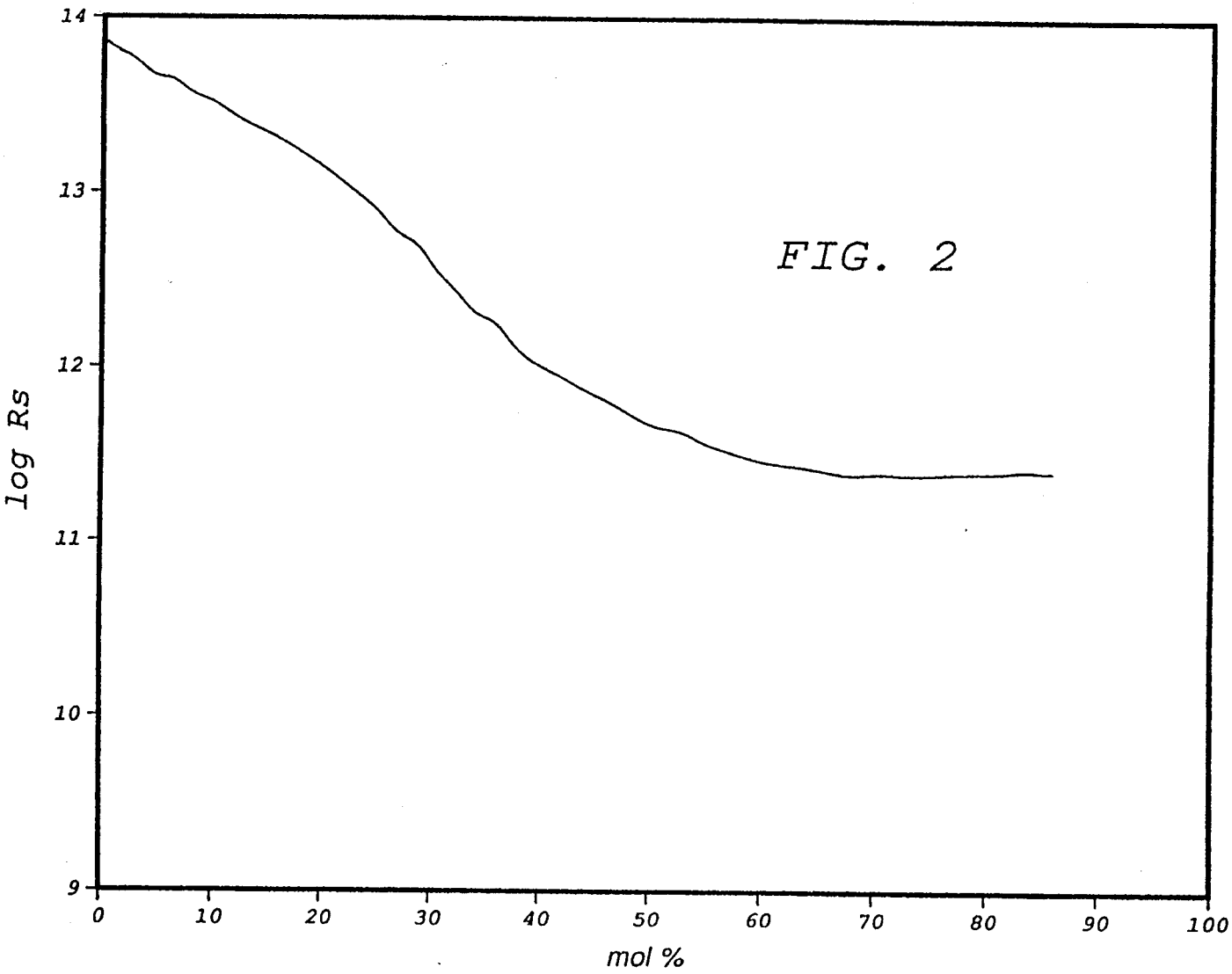

FIG. 2 represents a graph wherein the surface resistivity (log $R_s$) of gelatin layers containing sulphonated cross-linked copolymers is plotted against the increasing transformation (in mole %) of carboxylate groups into sulpho-alkyl acrylate groups. The copolymer before said transformation contained 80 mole % of carboxylate recurring units. The surface resistivity measurement has been effected on gelatin layers in which the differently sulphonated copolymers have been applied with respect to gelatin in a weight coverage ratio of 1.8 g/m$^2$/0.56 g/m$^2$. These copolymer/gelatin layers were coated with a hardened gelatin layer having a coverage of 3 g/m$^2$ of gelatin and 0.0424 g/m$^2$ of formaldehyde. The hardening proceeded for 3 days at 57° C. and relative humidity of 34%. Before affecting the surface resistivity measurement said layers were treated with an alkaline developer liquid, acidic fixing liquid (pH: 4.3) and neutral tap water having a total hardness corresponding with 130 parts of calcium carbonate per million of water. After said treatment said layers were dried and conditioned for 15 h at 21° C. at a relative humidity (R.H.) of 30% as mentioned in Example 1.

The surface resistance expressed in ohm/square (ohm/sq.) is measured by a test proceeding as follows:

two conductive copper poles having a length of 10 cm parallel to each other were placed at a distance of 1 cm onto the surface to be tested and the resistance built up between said electrodes is measured with a precision ohm-meter. By multiplying the thus determined ohm value with the factor 10 the surface resistance value expressed as ohm/square (ohm/sq) is obtained.

The cross-linked sulphonated latex-type copolymer for use according to the present invention can be mixed homogeneously with aqueous hydrophilic colloid solutions containing proteinaceous colloids such as gelatin, polysaccharide, polyvinyl alcohol, polyacrylamides and poly-N-vinylpyrrolidinone, including the use of mixtures of said hydrophilic colloids. Among these the most preferred binding agent for photographic silver halide emulsion layer materials is gelatin.

Layers with good antistatic properties even after wet processing applied for photographic silver halide emulsion materials are obtained by coating the sulphonated cross-linked copolymer at a coverage in the range of 1.6 to 3 g/m$^2$.

A coverage of copolymer of at least 1.6 g per m$^2$ and weight ratio of 50/50 with respect to hydrophilic colloid binder, e.g. gelatin, can yield antistatic layers that withstand very well the conductivity decreasing action of Ca, Ng and Al cations present in tap water of which the total hardness is equivalent with 130 parts of calcium carbonate per million of water. When covering said antistatic layers with a sufficiently hardened gelatin layer the conductivity decreasing influence of said cations is still further reduced.

The upper value of copolymer coverage is limited actually by physical properties other than electrical conductivity of the antistatic layer. For example, a silver halide emulsion film comprising an outermost antistatic layer incorporating in a hydrophilic colloid binder more than 3 g/m$^2$ of said cross-linked sulphonated copolymer has a too low a scratch resistance, too high a water adsorptivity, and shows poor dimensional stability, so that for application in silver halide films the coverage is kept preferably below that value.

A preferred recording material according to the present invention comprises one or more light-sensitive silver halide emulsion layers and said antistatic layer is present:

as outermost layer at the silver halide emulsion layer side of said photographic silver halide emulsion layer material, and/or as a back layer at the side of the support opposite the silver halide emulsion layer(s) of said photographic silver halide emulsion layer material, and/or as a stratum between the support and a silver halide emulsion layer or a silver halide emulsion layer assembly of said photographic silver halide emulsion layer material.

According to a first embodiment said cross-linked sulphonate copolymer has been coated from an aqueous dispersion in a coverage of dry copolymer in the range of at least 1.6 to 2.2 g/m$^2$ on a resin support and the obtained layer has been coated with a hardened gelatin covering layer at a coverage of 2.0 to 5.0 g/m$^2$. Such layer assemblage serves e.g. as backing layer of a photographic silver halide emulsion layer material. With said layer assemblage the photographic material obtains a good antistatic character and maintains said character also when said material is dried subsequently to the treatment with an aqueous acidic liquid, e.g. aqueous acidic fixing stop bath of pH 4.3, applied after development of an imagewise exposed photographic silver halide emulsion layer material. Said covering layer of hardened gelatin gives sufficient protection against mechanical damage to the thus coated material during handling or roller transport in a photographic processing apparatus.

According to a second embodiment said said cross-linked sulphonste copolymer is present on a resin support in a coverage of at least 2.2 g per m$^2$ in admixture with a hydrophilic colloid binder in a weight ratio of 70/30 to 80/20 with respect to said hydrophilic colloid binder and said layer stands in direct contact with a gelatin-silver halide emulsion layer of a photographic silver halide emulsion layer material.

The gelatin-silver halide emulsion layer that may be coated with an anti-abrasion layer on the basis of hardened gelatin. Of such material the surface resistance is low enough to prevent electrostatic dust attraction at a relative humidity of 30% even when said material had been treated previously with an acidic aqueous fixing liquid for silver halide (pH lower than 5.0) and rinsed with tap water.

It has been found experimentally by us that an antistatic layer with a surface resistivity corresponding with a log $R_s$ value equal to or lower than 11.5 will offer no or very poor electrostatic dust attraction determined by a test as described in Example 1.

According to a third embodiment a layer coated from a latex containing said said cross-linked sulphonate copolymer in the absence of hydrophilic colloid binder is applied as antistatic stratum between a resin support and a silver halide emulsion layer of a photographic silver halide emulsion layer material.

The coating composition of an antistatic layer containing said cross-linked sulphonate copolymer may contain other ingredients such as ionic and non-ionic surfactants, e.g. polyoxyethylene compounds improving conductivity, wetting agents as coating aid, e.g. perfluorinated surfactants, matting agents, pigments, and dyes.

According to a particular embodiment an antistatic layer containing said cross-linked sulphonate copolymer is used in combination with colloidal silica or a colloidal silica layer as described e.g. in U.S. Pat. No. 3,525,621 and published European patent application 0 334 400 A1.

A web or sheet according to the invention can incorporate more than one antistatic layer, each incorporating the ionic cross-linked latex-type copolymer as herein defined. For example there may be one such antistatic layer on each side of a hydrophobic resin support or resin-coated paper. In that way a particularly high resistance to dust attraction and sparking can be achieved.

As described hereinbefore in a particular embodiment the antistatic layer is covered with a thin protective layer, e.g. on the basis of hardened gelatin. Suitable hardeners for gelatin are aldehyde hardeners, e.g. formaldehyde, N-methylol compounds, quinones, carboxylic acid and carbamic acid derivates, sulfonate esters and sulfonyl halides, halogen compounds, epoxides, aziridines, olefines, isocyanates, carbodiimides, isoxazolium salts and vinylsulfonyl compounds as described e.g. in U.S. Pat. No. 4,845,024 and U.S. Pat. No. 4,894,324. A preferred vinylsulfonyl compound is $CH_2{=}CH{-}SO_2{-}CH_2{-}SO_2{-}CH{=}CH_2$. A survey of suitable hardeners is given e.g. in "The Theory of the Photographic Process" by T. H. James (Macmillan Publ. Co.), 1977, p. 79–84.

A preferred protective layer is made from gelatin hardened up to a degree corresponding with the addition of 0.03 g of formaldehyde per gram of gelatin. The gelatin coverage in the protective layer is preferably not higher than 3 g per m$^2$ and is more preferably in the range of 1 to 2 g per m$^2$.

In admixture with the hardened gelatin the protective layer may contain friction-lowering substance(s) such as dispersed wax particles (carnaubawax or montanwax) or polyethylene particles, fluorinated polymer particles, silicon polymer particles and/or calcium complexing agents.

A common support of a photographic silver halide emulsion material is a hydrophobic resin support or hydrophobic resin coated paper support.

Hydrophobic resin supports are well known to those skilled in the art and are made e.g. of polyester, polystyrene, polyvinyl chloride, polycarbonate, preference being given to polyethylene terephthalate. A preferred resin coated paper support is a poly-Alpha-olefin coated paper support such as a polyethylene coated paper support.

The hydrophobic resin support may be provided with one or more subbing layers known to those skilled in the art for adhering thereto a hydrophilic colloid layer. Suitable subbing layers for polyethylene terephthalate supports are described e.g. in U.S. Pat. No. 3,397,988, 3,649,336, 4,123,278 and 4,478,907.

Polyester films such as polyethylene terephthalate films are manufactured normally by a process wherein the films are molecularly oriented by stretching in two mutually perpendicular directions. The process is conveniently accomplished by sequentially stretching a flat amorphous polyester film first in one direction and then in another direction perpendicular thereto. Generally, the film is stretched first in the longitudinal direction, i.e. in the direction of passage through the stretching machine, and then in the transverse direction. The stretched films may also be dimensionally stabilised by heat-setting under dimensional restraint. Stretching and heat setting is conventionally carried out by heating the film above ambient temperature.

On using a stretchable resin support, e.g. polyethylene terephthalate resin support, the coating from aqueous medium of the ionic cross-linked copolymer dispersed in dissolved hydrophilic colloid binder is applied preferably on such support after longitudinal and transverse stretching. Said stretching is carried out normally in the temperature range of 80° to 100° C. The stretched film is normally heat-set by heating in the range of 180° to 200° C. for 0.1 to 2 minutes while it is retained from shrinkage.

The coating of the antistatic layer composition on its support may proceed by any coating technique known in the art for applying gelatin coatings, e.g. by doctor blade coating, air knife coating, curtain coating, slide hopper coating or meniscus coating, which are coating techniques known from the production of photographic silver emulsion layer materials.

For the composition of silver halide emulsion layers whereto said antistatic layer may be applied reference is made e.g. to Research Disclosure 17,643 of December 1978, and Research Disclosure 307,105 of November 1989.

Photographic silver halide emulsion materials containing an antistatic layer according to the present invention may be of any type known to those skilled in the art. For example, the antistatic layer is useful in continuous tone or halftone photography, microphotography and radiography, in black-and-white as well as colour photographic materials.

In a particular embodiment of the present invention a silver halide photographic material is used that is provided at the rear side of the support (the side opposite the light-sensitive layer(s)) with an antihalation coating containing one or more pigments in admixture with a binder and the antistatic layer is applied thereon or between the support and the antihalation coating. The antireflection substance used in the antihalation coating, e.g. carbon black, may itself have antistatic properties. According to another embodiment the antistatic layer is dyed with an antihalation dye that can be removed in the processing, e.g. by alkaline treatment or by a solvent or solvent mixture.

Apart from its use in photosensitive silver halide emulsion materials the above defined antistatic layer may be present in a non-photosensitive recording material serving as image-receiving material in the silver complex diffusion transfer process or in a dye diffusion transfer process as described e.g. in Angew. Chem. Int. Ed. Engl. 22, (1983) p. 191–209.

An antistatic layer according to the present invention is useful likewise in reducing surface resistance of non-photosensitive mounting or drafting film which is considered likewise as being a recording material.

By using a recording material having an antistatic layer according to the present invention the problems caused by static charges prior to and after wet processing can be avoided or substantially reduced. Such means for example that the formation of static charges by contact of a silver halide emulsion layer side with the rear side of the recording material or caused by friction with substances such as rubber and hydrophobic polymeric binder, e.g. the binder constituent of phosphor screens used as X-ray intensifying screens, can be markedly reduced by employing the present antistatic layer. The building up of static charges and subsequent dust attraction and/or sparking, e.g. during loading of films in cassettes, e.g. X-ray cassettes, or in cameras, or during the taking or projection of a sequence of pictures as occurs in automatic cameras or film projectors is prevented.

The examples hereinafter set forth are directed to the use of an antistatic layer in combination with a polyethylene terephthalate resin support but other resin bases, e.g. made of polystyrene, polyvinyl chloride, cellulose ester such as cellulose triacetate, or polyethylene either or not treated by corona-discharge and/or subbed with (a) subbing layer(s) for improving the adherence of hydrophilic colloid layers will obtain a strong reduction in surface resistance when coated with the herein described antistatic layer.

The following examples illustrate the present invention without however limiting it thereto.

All percentages and ratios are by weight unless otherwise mentioned.

EXAMPLE 1 (comparative example)

Subbed polyethyleneterephthalate support webs having a thickness of 175 μm were coated respectively with an antistatic layer A, B, C, D or E as described hereinafter. The dried antistatic layers were coated with a protective hardened gelatin layer as described hereinafter.

Preparation of the comparative antistatic material A

For the preparation of the antistatic layer composition A the following ingredients were mixed at 38° C.:

- 40 ml of the cross-linked carboxylate copolymer prepared according to Preparation III (the K+-polymer) containing 14.77 g of said copolymer per 100 g of dispersion (latex),
- 20.7 ml of 10% aqueous gelatin solution,
- 3.6 ml of an aqueous 4% formaldehyde solution,
- 1.5 ml of an aqueous 5% solution of surfactant S1 as described hereinafter,
- 1N aqueous sodium hydroxide solution to adjust the pH to 7, additional demineralized water to totalize 100 ml of coating composition.

Said coating composition while kept at 38° C. was doctor-blade coated onto the above mentioned subbed polyethylene terephthalate support being kept on a thermostatically conditioned hollow metal coating platen wherethrough running water having a temperature of 38° C. was led. The wet coating thickness was 27 μm.

Immediately after coating the coating platen was cooled with tap water to set the gelatin in the coated layer. After setting the obtained solid layer was dried for 10 min in a ventilated desiccator cabinet at 40° C. The dried layer had a coverage of 2.16 g/m$^2$.

For the preparation of the hardened gelatin covering layer A the following ingredients were mixed at 38° C.:

- 60 ml of a 10% aqueous gelatin solution,
- 2.7 ml of an aqueous 4% formaldehyde solution,
- 1.5 ml of an aqueous 5% solution of surfactant S1 as described hereinafter,
- 1N aqueous sodium hydroxide solution to adjust the pH to 7, additional demineralized water to totalize 100 ml of coating composition.

The surfactant S1 is octyl-phenylene-$(OCH_2CH_2)_8$—O—$CH_2$—COOH.

Said coating composition being kept at 38° C. was doctor-blade coated onto the dried antistatic layer while keeping the above mentioned subbed polyethylene terephthalate support in contact with the already mentioned coating platen thermostatically kept by running water at 38° C. The wet coating thickness was 40 μm.

Immediately after coating the coating platen was cooled with tap water to set (i.e. to gel) the gelatin in the coated layer. After setting the obtained solid layer was dried for 10 min in a ventilated desiccator cabinet at 40° C. The dried layer had a coverage of 3.0 g/m$^2$.

The preparation of the antistatic materials B, C, D and E proceeded as described for material A with the proviso that for preparing the antistatic layer the sulphonated cross-linked latex copolymer prepared according to Preparation IV and other coating ingredients mentioned in Table 1 were used in the amounts (ml) given. In 100 g of dispersion 14.98 g of copolymer was present.

For each latex compostion the copolymer content was 15.26% as in the preparation of the comparative material A.

The antistatic layers were coated with hardened gelatin layers of different composition and layer thickness as expressed in Table 2.

Before effecting surface resistivity measurements the materials A, B, C and D were kept in a conditioning cabinet for 3 days at 57° C. at a relative humidity (R.H.) of 34% to complete the hardening reaction in the gelatin. Thereupon the materials were kept for 15 h at 21° C. at a relative humidity (R.H.) of 30%.

The surface resistivity ($R_s$) was measured with the electrode set up already described hereinbefore and expressed in ohm/square as logarithmic values (log $R_s$).

Surface resistivity measurements were effected on said antistatic materials A, B, C, D and E after subjecting them to a treatment with aqueous processing liquids used in silver halide photography and re-conditioning after drying for 15 h at 21° C. in an atmosphere of 30% relative humidity.

The log $R_s$ values before and after processing of the antistatic materials composed as mentioned in Table 2 are given in Table 3.

Before and after processing the antistatic materials were subjected to a dust attraction test (D.A.T.) which was carried out after conditioning said materials for 15 h at 21° C. and relative humidity of 30%. For carrying out said test the materials were placed with their supports down onto a glass plate and rubbed at the antistatic layer side with a woolen cloth. After said rubbing ashes of a cigarette were cascaded over the tilted surface. In Table 3 the materials whereon dust remained are indicated with "+" and the materials free from dust are indicated by "−".

TABLE 1

| | Antistatic layer coating compositions referred to as B, C, D and E. | | | | | |
|---|---|---|---|---|---|---|
| | Latex Prep. IV | Gelatin solution | Surfactant solution | Hardening solution | Layer thickness | |
| Ref. | ml | ml | ml | ml | wet µm | dry µm |
| B | 40.61 | 20.7 | 1.5 | 3.61 | 27 | 2.21 |
| C | 45.74 | 20.7 | 1.5 | 3.93 | 27 | 2.36 |
| D | 50.87 | 20.7 | 1.5 | 4.27 | 27 | 2.57 |

TABLE 1-continued

| | Antistatic layer coating compositions referred to as B, C, D and E. | | | | | |
|---|---|---|---|---|---|---|
| | Latex Prep. IV | Gelatin solution | Surfactant solution | Hardening solution | Layer thickness | |
| Ref. | ml | ml | ml | ml | wet µm | dry µm |
| E | 55.90 | 20.7 | 1.5 | 4.60 | 27 | 2.76 |

The pH of each coating composition was adjusted to 7 by adding an aqueous 1N sodium hydroxide solution whereupon the volume of each coating composition was brought to 100 ml by adding demineralized water.

TABLE 2

| Material | Layer of Ref. | Gelatin solution ml | Surfactant solution ml | Hardening solution ml | Layer thickness wet µm | Layer thickness dry µm |
|---|---|---|---|---|---|---|
| B1 | B | 40 | 1.5 | 1.8 | 50 | 2.0 |
| B2 | B | 67 | 1.5 | 3.0 | 75 | 5.0 |
| C1 | C | 60 | 1.5 | 2.7 | 50 | 3.0 |
| C2 | C | 67 | 1.5 | 3.0 | 75 | 5.0 |
| D1 | D | 60 | 1.5 | 2.7 | 50 | 3.0 |
| D2 | D | 67 | 1.5 | 3.0 | 75 | 5.0 |
| E1 | E | 60 | 1.5 | 2.7 | 50 | 3.0 |
| E2 | E | 67 | 1.5 | 3.0 | 75 | 5.0 |

TABLE 3

| | Layer composition | | log $R_s$ | | D.A.T. | |
|---|---|---|---|---|---|---|
| | Antistatic layer copol./gelatin ratio of g/m² | Covering layer gelatin g/m² | Before processing | After processing | Before processing | After processing |
| Material | | | | | | |
| A | 1.6/0.56 | 3.0 | 9.7 | 13.9 | − | + |
| B1 | 1.6/0.56 | 2.0 | 11.45 | 11.23 | − | − |
| B2 | 1.6/0.56 | 5.0 | 11.60 | 11.80 | + | + |
| C1 | 1.8/0.56 | 3.0 | 11.34 | 11.45 | − | − |
| C2 | 1.6/0.56 | 5.0 | 11.60 | 11.80 | − | − |
| D1 | 2.0/0.56 | 3.0 | 11.20 | 11.20 | − | − |
| D2 | 2.0/0.56 | 5.0 | 11.30 | 11.10 | − | − |
| E1 | 2.2/0.56 | 3.0 | 11.10 | 11.00 | − | − |
| E2 | 2.2/0.56 | 5.0 | 11.20 | 11.00 | − | − |

The processing proceeded with the following developing liquid, fixing and rinsing liquid at the indicated temperature and processing time.

| | |
|---|---|
| Composition of the developing liquid (pH: 10.1) - (35° C., 27 s). | |
| Hydroquinone | 30 g/l |
| Potassium sulphite | 64 g/l |
| 1-Phenyl-3-pyrazolidinone | 1.5 g/l |
| Potassium bromide | 4 g/l |
| Glutardialdehyde | 4.7 g/l |
| The pH was adjusted at 10.1 w1th bicarbonate/carbonate buffer | |
| Composition of the fixing liquid (pH: 4.3) - (34° C., 18 s). | |
| Ammonium thiosulphate | 132 g/l |
| Sodium sulphite | 10.8 g/l |
| Aluminium sulphate | 5.4 g/l |
| The pH was adjusted at 4.3 with acetic acid/acetate buffer | |

The rinsing proceeded with tap water at a temperature of 27° C. for a duration of 28 s. The tap water had a total hardness corresponding with 336 parts of calcium carbonate per million of water.

EXAMPLE 2

A silver bromoiodide emulsion (2 mole % of silver iodide) for use in radiography with intensifying screens was prepared in such a way that it contained silver halide grains with an average grain size of 1.25 μm and comprised per kg an amount of silver halide corresponding to 190 g of silver nitrate and 74 g of gelatin. As stabilizing agents the emulsion contained per kg 545 mg of 5-methyl-7-hydroxy-s-triazolo[1,5-a]pyrimidine and 6.5 mg of 1-phenyl-5-mercaptotetrazole.

The above emulsion was coated on both sides of of a double side subbed polyethylene terephthalate support coated also at both sides with the antistatic coating composition enumerated under E in the above Table 1 applied at a copolymer coverage of 2.2 g per $m^2$. Before coating each emulsion layer onto each dried antistatic layer a hardened gelatin covering layer was applied at a gelatin coverage of 3.00 g per $m^2$. The hardening proceeded by adding 0.03 grams of formaldehyde per gram of gelatinin. On each side of the support each silver halide emulsion layer contained an amount of silver halide equivalent with 7 g of silver nitrate per $m^2$.

The exposure proceeded between blue light emitting $CaWO_4$ intensifying screens and the processing of the exposed photographic material proceeded as described in Example 1.

Before measuring the surface resistance as defined hereinbefore the dried radiographic material was subjected to a 2 h conditioning at 30° C. and 30% R.H. The surface resistance expressed as log $R_s$ was 11.3.

The processed and conditioned material was subjected to the above defined dust attraction test and showed no dust retention by electrostatic attraction.

We claim:

1. A photographic element containing a silver halide emulsion layer on a sheet, ribbon or web support, wherein said element comprises an antistatic layer that contains a hydrophilic binder and an ionic crosslinked addition copolymer which includes each of the following recurring units (1), (2), (3) and (4) wherein:

recurring units (1) are formed by acrylic and/or methacrylic acid aliphatic ester groups present up to 19 mole % with regard to the totality of recurring units in the copolymer, recurring units (2) are formed by acrylic and/or methacrylic acid salt groups present up to 30 mole % with regard to the totality of recurring units of the copolymer, wherein a part of said amount of said groups can be transformed into free acid groups, recurring units (3) are formed by tetraallyloxyethane as polyfunctional crosslinking monomer in an amount of 1 to 10 mole % with respect to the totality of recurring units of the copolymer, and recurring units (4) contain a sulphonic acid salt group obtained via a reaction of propane sultone or butane sultone with carboxylic acid salt groups of originally present recurring units (2) in free acid form, wherein the recurring units (4) are present for at least 30 mole % of the recurring units of said copolymer, and contain linked to the polymer backbone the group $—COO—(CH_2)_n—SO_3—.M^+$, wherein n is 3 or 4, and $M^+$ is a cation selected from the group consisting of an alkali metal cation and onium group, and said antistatic layer contains said copolymer at a coverage in the range of 1.6 to 3 g/$m^2$ and a weight ratio of up to 50/50 with respect to a hydrophilic binder.

2. A photographic element according to claim 1, wherein said sulphonic acid salt groups are selected from the group consisting of alkali metal salt and onium salt groups.

3. A photographic element according to claim 1, wherein said antistatic layer contains said ionic crosslinked copolymer at a coverage in the range of 1.6 to 3 g/$m^2$.

4. A photographic element according to claim 1, wherein said antistatic layer incorporating said ionic copolymer is present on an antihalation coating.

* * * * *

UNITED STATES PATENT AND TRADEMARK OFFICE

CERTIFICATE OF CORRECTION

PATENT NO. : 5,364,752

DATED : November 15, 1994

INVENTOR(S) : Daniel M. Timmerman et al

It is certified that error appears in the above-indentified patent and that said Letters Patent is hereby corrected as shown below:

On the title page, item
[21] Appl. No.: "9,731" should read -- 109,731 --;

Column 6, line 52, "butane suitone" should read -- butane sultone --;

Column 8, line 46, "Ca, Ng and Al" should read -- Ca, Mg and Al --.

Signed and Sealed this

Fourth Day of April, 1995

*Attest:*

Bruce Lehman

BRUCE LEHMAN

*Attesting Officer*

*Commissioner of Patents and Trademarks*